US007270451B1

(12) United States Patent
Swanson

(10) Patent No.: US 7,270,451 B1
(45) Date of Patent: Sep. 18, 2007

(54) TORCHIERE LAMP

(75) Inventor: Dennis K. Swanson, Chatsworth, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 0 days.

(21) Appl. No.: 11/031,134

(22) Filed: Jan. 6, 2005

(51) Int. Cl.
*F21S 8/08* (2006.01)

(52) U.S. Cl. ..... 362/414; 362/410; 362/260

(58) Field of Classification Search ..... 362/414
See application file for complete search history.

(56) References Cited

U.S. PATENT DOCUMENTS 5,130,910 A * 7/1992 Engel ..... 362/217
5,377,086 A * 12/1994 Tickner ..... 362/235
5,528,473 A * 6/1996 Kassay et al. ..... 362/247
6,109,766 A * 8/2000 Baliozian ..... 362/287
6,152,583 A * 11/2000 Langner ..... 362/427
6,168,299 B1 * 1/2001 Yan ..... 362/365
6,206,545 B1 * 3/2001 Yan ..... 362/249
6,439,748 B1 * 8/2002 Hsieh ..... 362/360
2003/0081421 A1 * 5/2003 Eusterbrock et al. ..... 362/414

* cited by examiner

*Primary Examiner*—Ali Alavi
*Assistant Examiner*—Hargobind S. Sawhney
(74) *Attorney, Agent, or Firm*—Billy A. Robbins; Fulbright & Jaworski

(57) ABSTRACT

A torchiere lamp which includes a plurality of at least three dedicated compact fluorescent bulbs which are disposed internally of an upwardly directed pan shaped member carried by a stem supported upon a base.

9 Claims, 3 Drawing Sheets

FIG. 4
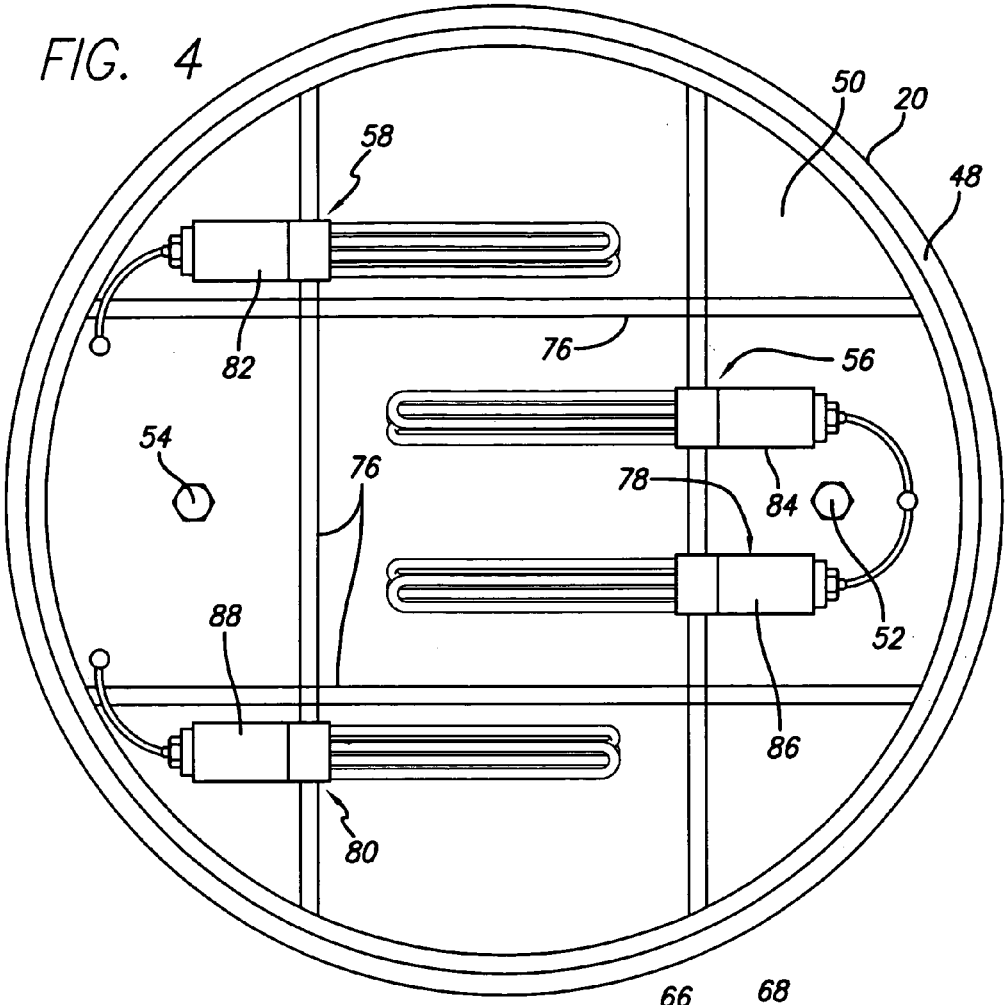
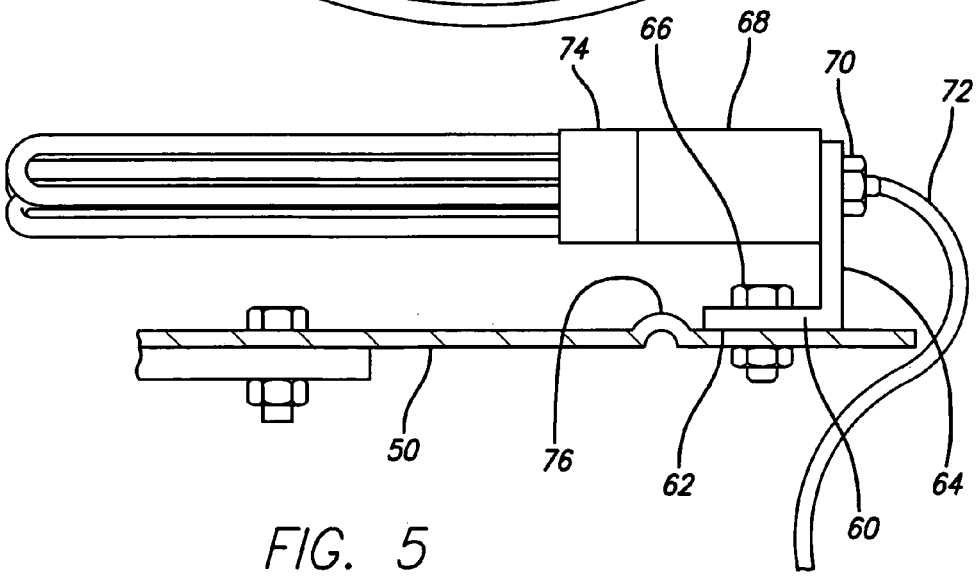
FIG. 5

TORCHIERE LAMP

CROSS-REFERENCE TO RELATED APPLICATIONS

Not applicable.

BACKGROUND OF THE INVENTION

The present invention relates generally to electric lighting apparatus and more particularly, to such apparatus which includes a plurality of fluorescent bulbs therein which bulbs are disposed within in an upwardly directed pan shaped member or reflector.

DESCRIPTION OF THE RELATED ART

Electric lighting apparatus in the form of floor lamps and table lamps is well known. Such lamps generally take the form of a general area lighting device or alternatively, a task lighting device. A general lighting apparatus is one which provides lighting for a predetermined area without particular concern for directing the light for reading, highlighting specific items such as paintings or the like or otherwise. Typically, the light eminating from a general lighting apparatus reflects off of the ceiling or other adjacent surfaces to illuminate the area surrounding the lighting apparatus. On the other hand, task lighting focuses the light through the utilization of reflector members for a specific purpose such as reading, illuminating a given area to accent some items such as a sculpture, painting or the like. An example of task lighting structures are the well known pole lamps or track lighting structures.

The present invention is particularly directed to such lighting apparatus which utilizes general lighting as at least a portion thereof. Such apparatus may also include task lighting or alternatively, it may have no task lighting of any type. In recent history, a tremendous volume of general lighting type, lighting equipment both with and without task lights has been sold. A large number of such general lighting devices have incorporated as the illumination element thereof a halogen bulb. The halogen bulb was selected because it provided an increased illumination of the general area surrounding the lamp. Such halogen bulb lamps however have fallen out of favor as a result of various hazardous conditions existing as a result of the intense heat generated by the halogen bulb. As a result thereof, the halogen bulbs have been replaced in many instances by incandescent bulbs and there has been some effort to replace the halogen bulbs with fluorescent lights.

In many lighting apparatus particularly task lighting a fluorescent bulb which is of low wattage but provides increased illumination has been utilized. Such low wattage fluorescent bulbs are generally long lasting and provide sufficient illumination for the performance of various tasks such as reading, doing puzzles, working board games, needlepoint, sewing or the like. It has however been found that such low wattage fluorescent bulbs have generally been ineffective to provide the greater illumination needed for general area lighting and particularly such illumination equivalent to that provided by a halogen bulb. Examples of such prior art lighting apparatus are found in U.S. Pat. Nos. 5,221,141 and 5,997,160.

BRIEF SUMMARY

A torchiere lamp having a base with a stem carried by the base, an upwardly directed pan shaped member is carried by the stem and a plurality of fluorescent light bulbs are disposed internally of the upwardly directed pan shaped member.

The foregoing has outlined rather broadly the features and technical advantages of the present invention. In order that the detailed description of the invention that follows may be better understood, additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 4 is a top plan view of the torchiere lamp as illustrated in FIG. 1 showing the positioning of the fluorescent light bulbs within the upwardly directed reflector; and FIG. 5 illustrates the manner in which the fluorescent bulbs are mounted within the reflector;

DETAILED DESCRIPTION OF THE INVENTION

Figure 1:
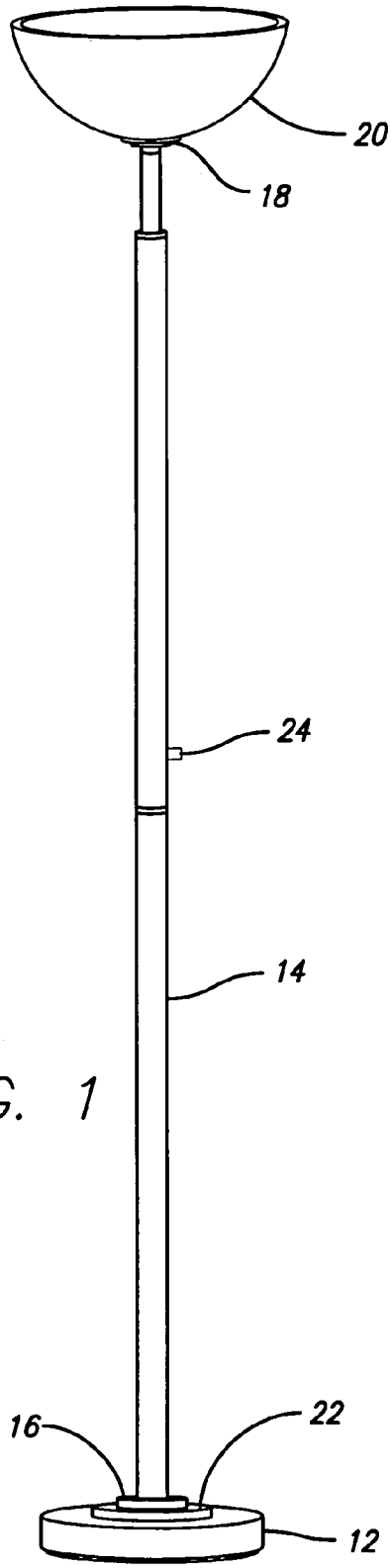
FIG. 1 is a perspective view of one embodiment of a torchiere lamp constructed in accordance with the principles of the present invention.

Referring now to the drawings and more particularly to FIG. 1 there is shown a perspective view of one embodiment of a torchiere lamp constructed in accordance with the principles of the present invention. As is therein illustrated, the lamp includes a base 12 which may be weighted if desired to provide stability to the lamp. Rising from the base 12 is a stem 14 having a first end 16 which is attached centrally to the base 12. At the opposite end 18 of the stem 14 there is an upwardly directed pan-shaped member 20. The stem 14 may be constructed in a plurality of sections which screw together to form the stem. The end 16 of the stem is threaded into a receptacle 22 affixed to the upper surface of the base 12. The utilization of a plurality of sections to the stem 14 which are screwed together is to provide a more convenient form for shipment of the lamp as illustrated in FIG. 1. The upwardly directed and pan shaped member 20 contains internally thereof a plurality of at least three dedicated fluorescent bulbs. Preferably these bulbs are compact fluorescent bulbs which provide the same light output as a halogen or incandescent bulb but create much less heat, use approximately one-quarter to one-third as much electricity and last up to ten times longer than a standard incandescent light. For some period of time consumers have replaced incandescent lamps with screw in compact fluorescent bulbs to provide approximately the same light as was available with the previously used incandescent light.

In accordance with the principles of the present invention, a plurality of dedicated compact fluorescent bulbs are utilized and such plurality of compact fluorescent bulbs provide approximately the same illumination as the previously used halogen bulbs but with a substantially less amount of heat and a substantial drop in the use of electricity as compared to the halogen bulb.

As is typical in torchiere lamps, there is provided a switch 24 which is used to turn the light carried by the pan shape member 20 on or off. In accordance with the present invention, the switch 24 is a three-way switch which can be used to vary the level of illumination emanating from the dedicated fluorescent bulbs carried by the pan shape member 20. For example in the first position one of the bulbs would be illuminated, in the second position three bulbs would be illuminated and in the fourth position, four bulbs would be illuminated assuming that there are four dedicated fluorescent bulbs contained within the interior of the pan shape member 20.

Figure 2:
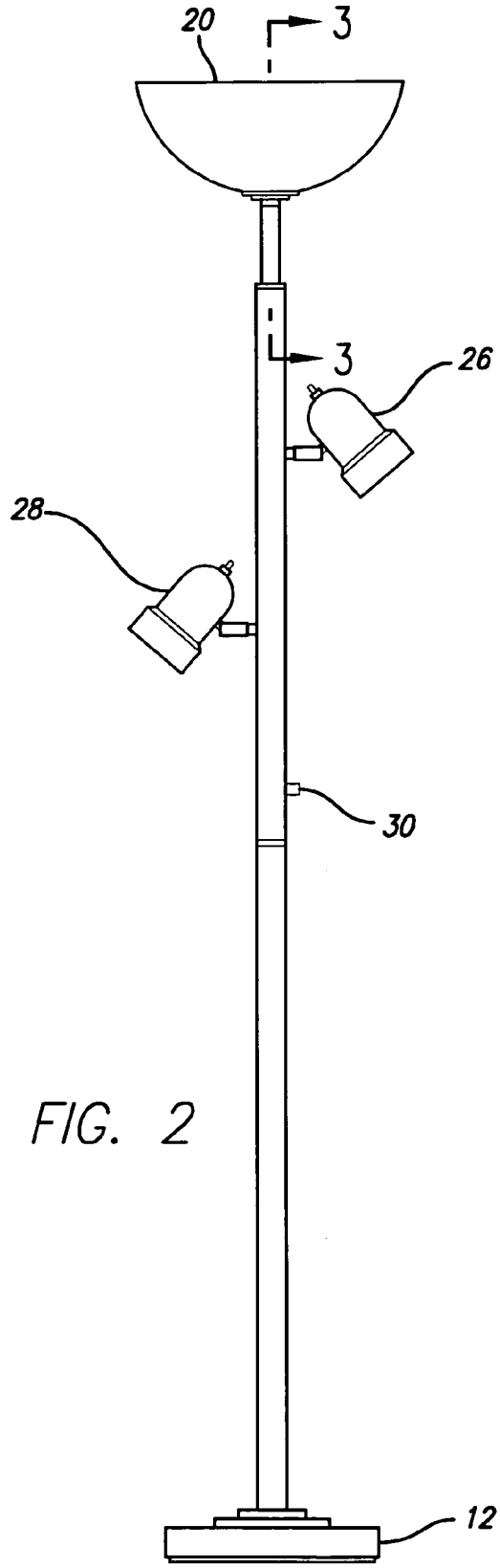
FIG. 2 is a side elevation view illustrating an alternative embodiment of a torchiere lamp constructed in accordance with the principles of the present invention.

Referring now more particularly to FIG. 2. There is illustrated in an elevational view an alternative embodiment of a torchiere lamp constructed in accordance with the principles of the present invention. The torchiere lamp is the same as that illustrated and described above with respect to FIG. 1, however, there has been added to the torchiere lamp along the stem a pair of task lights 26 and 28. These task lights are positioned with the task light 28 approximately two/thirds of the way from the base 12 toward the pan shape member 20 and with the other task light 26 being positioned approximately half way between the task light 28 and the pan shape member 20. A tree torchiere with task lights connected to the stem thereof is known and is illustrated by the U.S. Pat. No. 5,221,141 above referred to. It is however, applicant's belief that there has not been in existence previously a torchiere utilizing a plurality of dedicated compact fluorescent bulbs within the upwardly directed pan like member carried by the top of the stem. Thus, the combination of the task lights with such a torchiere is believed to be novel. When a structure of the type as shown in FIG. 2 is utilized a switch 30 would be used to control not only the dedicated fluorescent bulbs disposed within the upwardly directed pan shape member 20 but also the task lights 26 and 28 individually and together. Although not shown in either FIG. 1 or FIG. 2, electrical wiring is utilized to connect electrical energy from a source thereof such as a wall plug to the lamps. The electrical wiring is carried through the stem 14 and connects to the various light means affixed to the stem and disposed within the upwardly directed pan shape member 20.

Figure 3:
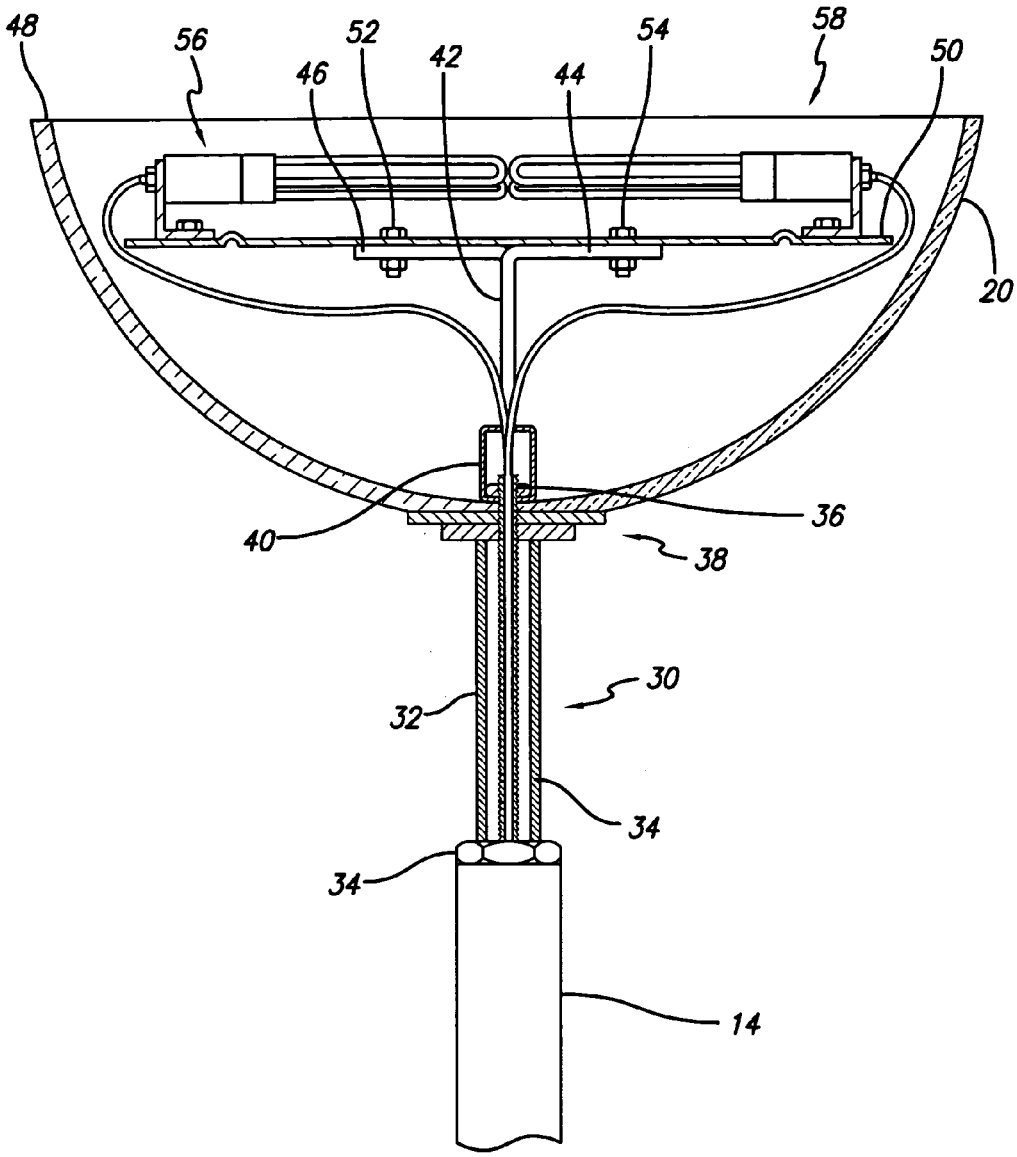
FIG. 3 is a partial cross-sectional view taken about the lines 3—3 of FIG. 2 and illustrating the manner in which the fluorescent bulbs are positioned within the upwardly directed reflector.

Referring now more particularly to FIGS. 3, 4 and 5 details of the construction of the torchiere lamp constructed in accordance with the principles of the present invention are illustrated and will be described. FIG. 3 is a partial cross-sectional view taken about the lines 3—3 of FIG. 2, FIG. 4 is a plan view of FIG. 1 illustrating the placement of the compact fluorescent bulbs within the upwardly directed pan shape member 20 and FIG. 5 is a partial cross-sectional view showing the mounting of one of the compact fluorescent bulbs integrated with the ballast.

As is shown in FIG. 3 the stem 14 terminates at its upper end 30 with a reduced diameter section 32 which is held in place on the stem by an appropriate nut 34. At the upper end of the reduced diameter section 32 there is provided a hollow nipple 36 which is threaded into the internally threaded portion of the section 32 and a step 38 is provided as a transition between the reduced diameter section 32 and the upwardly directed pan shape member 20. The pan shape member 20 is held in place on steps 38 by an appropriate nut or other similar locking structure as may be desired. A riser 40 is affixed to the nipple 36 by being threaded thereon. At the upper end of the riser there is supported a bracket 42 having a pair of arms 44 and 46 emanating there from. A mounting plate 50 is secured to the arms 44 and 46 of the bracket 42 by appropriate fasteners 52 and 54. As can be seen, the mounting plate 50 is thus supported internally of the upwardly directed pan like member 20 but below the rim 48 of the pan shape member 20. As illustrated in FIG. 3, a pair of dedicated fluorescent bulbs 56 and 58 are carried by a mounting plate 50 so that the bulbs 56 and 58 are disposed below the rim 48.

The integrated dedicated fluorescent bulbs may be carried by the mounting plate 50 in various means. A preferred form for supporting the fluorescent bulbs on the mounting plate 50 is illustrated in FIG. 5 to which reference is hereby made. As is therein shown, an angle iron 60 having a first leg 62 and a second leg 64 is affixed to the mounting plate 50 by an appropriate fastening member 66 which passes through the first leg 62 and is secured to the mounting plate 50. A ballast 68 is secured to the other leg 64 of the angle iron 60 by means of an appropriate fastener 70. An electrical cord 72 passes through the mounting plate 50 by way of an opening provided therefor to provide electrical energy to the ballast 68. Connected to the ballast 68 is a compact fluorescent bulb 74 which has appropriate pin connectors that engage receptacles provided in the ballast 68. The compact fluorescent bulb 74 may take various forms, but in the preferred embodiment the compact fluorescent bulb is comprised of three tubes which are folded. As is also illustrated in FIG. 5, the mounting plate 50 may have a plurality of stiffening groves such as illustrated at 76 formed therein.

As is shown in FIG. 4 to which reference is hereby made the pan shaped member 20 having an upper rim 48 has a mounting plate 50 supported on the bracket 42 by way of the fasteners 52 and 54. The mounting plate has the stiffening grove 76 formed therein to cause the plate 50 to become more rigid and to thereby more evenly and adequately support the dedicated fluorescent bulbs carried by it. As it illustrated in FIG. 4 there are four dedicated compact fluorescent bulbs 56, 58, 78 and 80. By dedicated fluorescent bulbs it is intended to mean that the fluorescent bulbs can only be used as fluorescent bulbs and cannot be replaced by removing the compact fluorescent bulbs and substituting an incandescent lamp therefor. This is in contrast to the prior art where incandescent bulbs have been replaced with compact fluorescent bulbs which have a screw in base thereon. The fluorescent bulbs used in conjunction with the present invention each contain connector pins which extend therefrom and which engage receptacles contained within the ballasts associated therewith. Thus, the ballast and the compact fluorescent bulbs are integral to provide the dedicated compact fluorescent lights which are disposed within the upwardly directed pan shape member 20. It is has been found that through the utilization of four such compact lights of approximately 32 watts each that a substantial amount of light is provided which equals or exceeds the amount of light provided by a halogen bulb contained within a similar torchiere structure.

There has thus been disclosed a torchiere lamp having a plurality of at least three and preferably four compact dedicated fluorescent bulbs integrated with a dedicated ballast which provides substantial illumination at greatly reduced heat and energy use as compared to the equivalent halogen lamp.

What is claimed is:

1. A torchiere lamp comprising:

a base;

a stem carried by said base;

an upwardly directed pan like member carried by said stem;

a plurality of at least three dedicated fluorescent light bulbs disposed internally of said upwardly directed pan like member;

a ballast operatively interconnected to said bulbs and disposed internally of said upwardly directed pan like member;

at least one angle iron;

a mounting plate disposed within said pan like member and disposed below said rim, said angle iron affixed to said mounting plate;

means for supporting at least some of said bulbs and said ballast in said pan like member on said at least one angle iron.

2. A torchiere lamp as defined in claim 1 wherein said upwardly directed pan like member includes a rim and said fluorescent light bulbs are all disposed below said rim.

3. A torchiere lamp as defined in claim 1 which further includes one ballast for each of said fluorescent bulbs and each said ballast is secured to said mounting plate by said angle iron and each said fluorescent bulb is connected to one of said ballasts.

4. A torchiere lamp as defined in claim 3 which has four dedicated compact fluorescent light bulbs, each including an integral ballast.

5. A torchiere lamp as defined in claim 4 wherein said mounting plate includes a plurality of stiffening grooves formed therein.

6. A torchiere lamp comprising:

a base;

a stem carried by said base;

an upwardly directed pan like member having a rim carried by said stem;

a plurality of at least four dedicated fluorescent light bulbs disposed internally of said upwardly directed pan like member and below said rim;

a mounting plate disposed within said pan like member and disposed below said rim;

one ballast for each of said fluorescent bulbs; and four angle irons each having first and second legs, said first leg of each angle iron being secured to said mounting plate, said second leg of each angle iron carrying one of said ballasts, one of said fluorescent bulbs connected to each of said ballasts.

7. A torchiere lamp as defined in claim 6 wherein said mounting plate includes a plurality of stiffening grooves formed therein.

8. A torchiere lamp comprising:

a base;

a stem carried by said base;

an upwardly directed metal pan like member carried by said stem, said pan like member having a rim;

a mounting plate disposed within said pan like member;

first, second, third and fourth fluorescent light ballasts;

means including an angle iron for mounting said first, second, third and fourth ballasts on said mounting plate within said pan like member below said rim positioned substantially equi-distance apart;

first, second, third and fourth dedicated fluorescent light bulbs; and means for connecting said first, second, third and fourth fluorescent light bulbs to said first, second, third and fourth fluorescent light ballasts, respectively.

9. A torchiere lamp as defined in claim 8 which further includes a bracket carried by said stem, said mounting plate being secured to said bracket.

* * * * *